United States Patent [19]

Zieke et al.

[11] Patent Number: 5,047,002

[45] Date of Patent: Sep. 10, 1991

[54] APPARATUS AND METHOD FOR MAKING Z-FOLDED ZIPPERED FILM

[75] Inventors: Larry M. Zieke, Midland, Mich.; James C. Pawloski, Bourbonnais, Ill.

[73] Assignee: Zip-Pak, Inc., Northbrook, Ill.

[21] Appl. No.: 589,178

[22] Filed: Sep. 27, 1990

[51] Int. Cl.[5] ..... B65H 18/00

[52] U.S. Cl. ..... 493/394; 493/214; 493/390; 156/66

[58] Field of Search ..... 493/390, 394, 409, 439, 493/440, 211, 213, 214; 156/66, 192

[56] References Cited

U.S. PATENT DOCUMENTS

| | | | |
|---|---|---|---|
| 3,815,317 | 6/1974 | Toss . | |
| 4,341,575 | 7/1982 | Herz | 493/213 X |
| 4,582,549 | 4/1986 | Ferrell | 156/192 X |
| 4,625,496 | 12/1986 | Ausnit . | |
| 4,646,511 | 3/1987 | Boeckmann et al. . | |
| 4,666,423 | 5/1987 | Herrington | 493/390 X |
| 4,704,842 | 11/1987 | Boeckmann et al. . | |
| 4,709,398 | 11/1987 | Ausnit | 156/66 X |
| 4,905,451 | 3/1990 | Jaconelli et al. | 493/440 X |
| 4,941,307 | 7/1990 | Wojcik . | |
| 4,994,128 | 2/1991 | Toshima | 156/66 |

*Primary Examiner*—Frederick R. Schmidt
*Assistant Examiner*—John A. Marlott
*Attorney, Agent, or Firm*—Thomas W. Buckman; John P. O'Brien; Donald C. Breh

[57] ABSTRACT

A method and apparatus for producing rolls of thermoplastic film stock wherein zipper elements are interlocked for structural support while the web is open, resembling a "Z" in cross-section, and ready for use on container and packaging machines.

16 Claims, 3 Drawing Sheets

FIG. 4
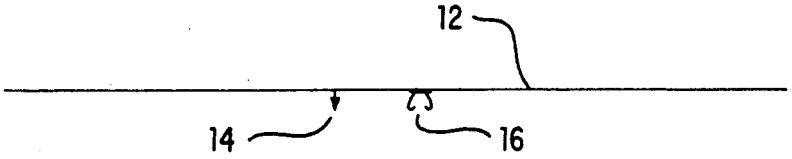
FIG. 5
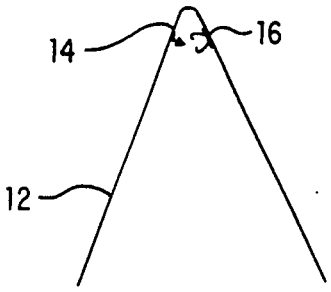
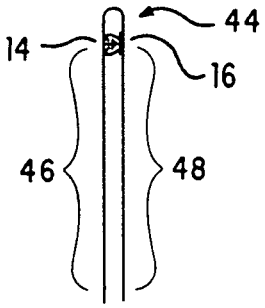
FIG. 6
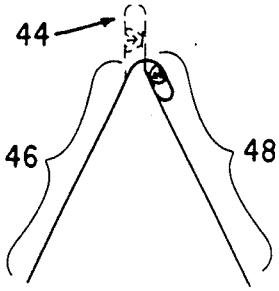
FIG. 7
FIG. 8
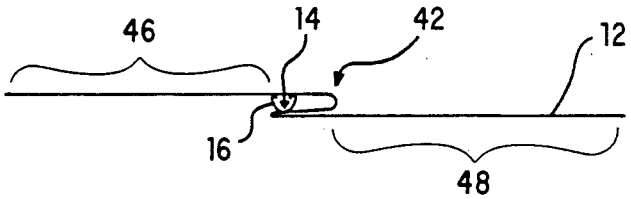

APPARATUS AND METHOD FOR MAKING Z-FOLDED ZIPPERED FILM

BACKGROUND OF THE INVENTION

The present invention relates to a method and apparatus for producing rolls of thermoplastic film stock for use in manufacturing flexible containers and product packaging, and in particular, to a method and apparatus for producing rolls of zippered film.

In the production of flexible containers, such as plastic bags and product packaging, film webs are supplied to manufacturers in rolls with and without zippers attached to the web. Zippered film is supplied in a variety of configurations including a "J-folded" closed zipper configuration, so called because its cross-section resembles the letter "J". Zippered film is also supplied in open zipper, open web configurations where the film web is opened flat and zipper elements are spaced apart either along opposite edges or near the center of the open web. Each of these configurations, shown in FIGS. 1A–1C, has been developed over the years to solve particular problems with one of the many types of packaging machines, and each has its own particular advantages and disadvantages.

The advantage of the J-folded film is that the interlocked zipper elements form a structure which protects the zipper elements during winding and storage in rolls. Typically, the disadvantage of J-folded film is the need to unfold the web before forming a container on a packaging machine. This step requires special equipment to be installed in what are typically confined areas. Further, drag induced by unfolding slows down the packaging or bag making process. See Boeckmann et al, U.S. Pat. No. 4,646,511, Col. 1, line 60-Col. 2, line 4 (the '511 patent).

Conversely, open zipper, open web configurations are not folded and, thus, are ready for use. However, their primary disadvantage is that damage may occur to the zipper elements during winding of the film into rolls. When disengaged, the zipper elements are unsupported and subject to tipping when there is too much winding pressure. Subsequent winding and the pressure of additional layers injures tipped zipper elements. To avoid damaging pressures, open zipper, open web rolls must be produced in smaller diameters, requiring more frequent spool changes and greater machine down-time when used.

In addition, both J-folded and open zipper, open web configuration film rolls require an additional machine or device to manipulate the film for use on a packaging machine. Among the numerous devices developed to meet that need are those of Ausnit, U.S. Pat. No. 4,625,496; Boeckmann et al, U.S. Pat. No. 4,704,842; Wojcik, U.S. Pat. No. 4,941,307; and the '511 patent. Each discloses a process wherein, at the infeed of a packaging machine, moving J-folded or open zipper, open web films are refolded into a closed zipper, open web configuration in transition to further manipulation to form flexible containers or product packaging. Again, however, the disadvantages of these devices include their slower speed, space requirements and the additional complexity they add to equipment needed to manipulate and variously position film for use at the point of packaging.

Accordingly, an improved apparatus and method for providing film rolls to packaging machinery are needed to overcome the drawbacks of prior art practices.

SUMMARY OF THE INVENTION

The present invention addresses these needs by providing a method and apparatus for producing rolls of closed zipper, open web film which is ready to use on many packaging machines. The closed zipper, open web film, referred to herein as Z-folded film because of its cross-section, combines the advantages of the closed zipper and open web configurations. The closed zippers are protected from damage, while the web is wound in an open configuration to facilitate numerous packaging and bag manufacturing applications. Rolls of Z-folded film may be produced remote from the point of bag or package manufacture, and supplied ready for use in manufacturing bags or packages. Equipment otherwise needed to manipulate known films for use at the point of manufacturing may be eliminated, thus ameliorating space problems, reducing machine complexity and improving machine speeds.

In accordance with the method of the present invention, a web of flexible material, preferably thermoplastic, is provided, opened flat with male and female zipper elements spaced apart thereon. The elements may be attached thereto or integral therewith. The web is then folded to bring the male and female zipper elements into opposing relationship, and the zipper elements interlocked. A folded lip is thus defined in the web portion between the zipper elements, and first and second web panels defined in the remaining web portions.

The folded lip is next urged to lay flat against one of the web panels and the web is unfolded, beginning at a point below the interlocked zipper elements. After unfolding, the web lays open while the interlocked zipper elements remain closed. The folded lip lays flat against either the first or second web panel, so that the first and second web panels and folded lip are in substantially parallel planes and the web resembles a "Z" in cross-section. The web, thus unfolded, is wound into a roll for later use in bag making or packaging machines.

The apparatus of the present invention comprises a series of rollers, roller pairs and other elements which may be positioned and mounted either in separate stations or grouped together on a single frame. Means for advancing the film in a direction of web movement, such as nip rollers, are placed at the outfeed or downstream end of the apparatus and are driven by conventional means. The nip rollers control the tension in the film as it advances from the infeed or upstream end through the apparatus. Preferably two pairs of nip rollers are provided, one pair each at the infeed or upstream end, and one pair at the outfeed or downstream end of the apparatus. Open zipper, open web film entering the apparatus advances to a means for folding the film. The means for folding preferably includes a folding board preceded by a first idler roller and followed by a pair of first pinch rollers. The first pinch rollers are spring-loaded and rotate by frictional contact with the web. This arrangement longitudinally folds the web in the direction of web movement, and brings male and female zipper elements into opposing relationship. Downstream therefrom, means for interlocking the zipper elements, such as a pair of spring-loaded joining rollers, are provided to interlock the zipper elements. A folded lip is thus defined in the area between the zipper elements, and the remaining portions of the web define web panels.

Downstream from the joining rollers, means for urging the folded lip to lay flat against one of the web panels are positioned. Preferably, a pair of second pinch rollers identical to the first pinch rollers urges the folded lip to lay flat against one of the web panels by holding the lip in such a position as it advances therethrough to a means for unfolding. The means for unfolding preferably includes an unfolding board placed after the second pinch rollers and positioned below the level of the interlocked zipper elements so as not to unlock the zipper elements. Unfolding is initiated below the zipper elements by the lowered position of the unfolding board relative to the interlocked zipper elements. The means for unfolding further includes a second idler roller at the downstream end of the unfolding board to complete the unfolding of the web panels initiated by the unfolding board. The web emerges from the second idler roller in substantially open position, with the zipper closed and the folded lip laid flat against a web panel, and advances into the means for advancing the web, preferably nip rollers as previously described. Thereafter, the web is wound by means for winding, such as a power-driven spool which winds the Z-folded film into a roll. During winding the spool is oscillated transverse to the direction of web movement to cause the web and zipper elements to wander back and forth across the roll, distributing and reducing pressure on the zipper elements.. Such oscillation permits the production of larger roll diameters, and results in a roll which is harder in the middle and softer near the edges.

It is accordingly, an object of the present invention to provide a method and apparatus for making a spool of Z-folded film in which zipper elements are interlocked for structural support and protection while the web is open in condition for ready use in a number of bag-making and packaging machines. It is another object of the present invention to make possible elimination of equipment at the point of manufacture by providing ready to use rolls of film, thereby increasing machine speeds. It is further an object of the present invention to reduce machine down time by providing larger rolls of film for use at the point of manufacture. These and other objects and advantages of the invention will become apparent from the following detailed description, the accompanying drawings, and the appended claims.

BRIEF DESCRIPTION OF THE DRAWINGS

FIG. 4 is a cross-sectional view of an open web, open zipper configuration film as provided to the method and apparatus of the present invention.

FIG. 5 is a cross-sectional view of the film of FIG. 4 at a point in the folding process.

FIG. 6 is a cross-sectional view of the film of FIG. 4 with interlocked zipper elements, showing the folded lip and web panels defined therein.

FIG. 7 is a cross-sectional view of the film of FIG. 6 at a point in the unfolding process.

FIG. 8 is a cross-sectional view of the film of FIG. 6 unfolded in preparation for winding into a roll.

DETAILED DESCRIPTION OF THE PREFERRED EMBODIMENT

Figure 1A:
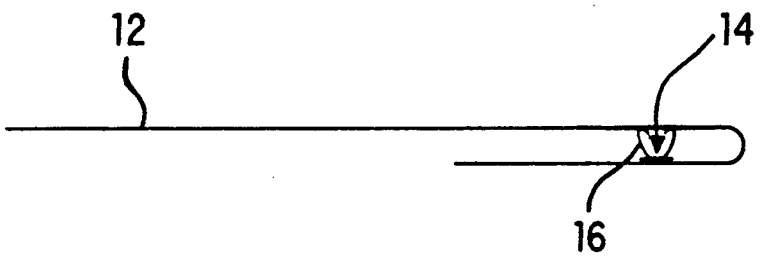
FIG. 1A PRIOR ART
FIG. 1A is a cross-sectional view of a "J-folded" closed zipper film as the art.
Figure 1B:
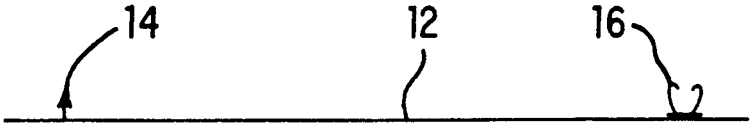
FIG. 1B PRIOR ART
FIG. 1B is a cross-sectional view of an open web, open zipper configuration film with opposing male and female zippers spaced apart along opposite edges of the web.
Figure 1C:
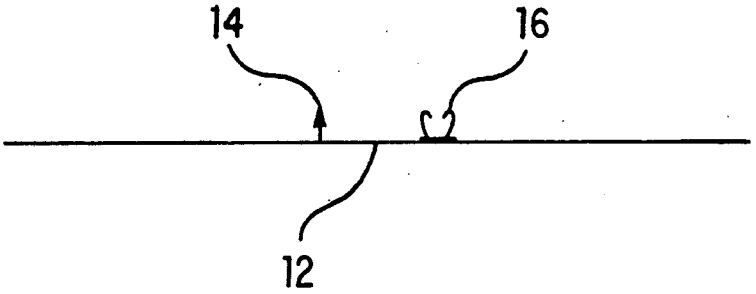
FIG. 1C PRIOR ART
FIG. 1C is a cross-sectional view of an open web, open zipper configuration film with opposing male and female zippers spaced apart near the center of the open web.
Figure 2:
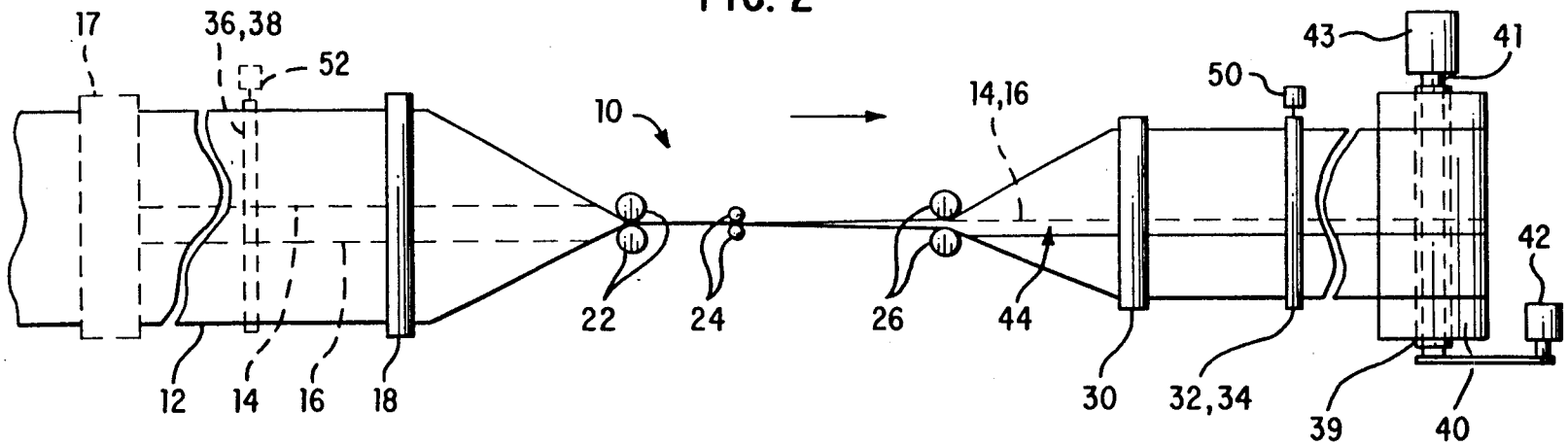
FIG. 2 is a schematic top view of the apparatus of the present invention.
Figure 3:
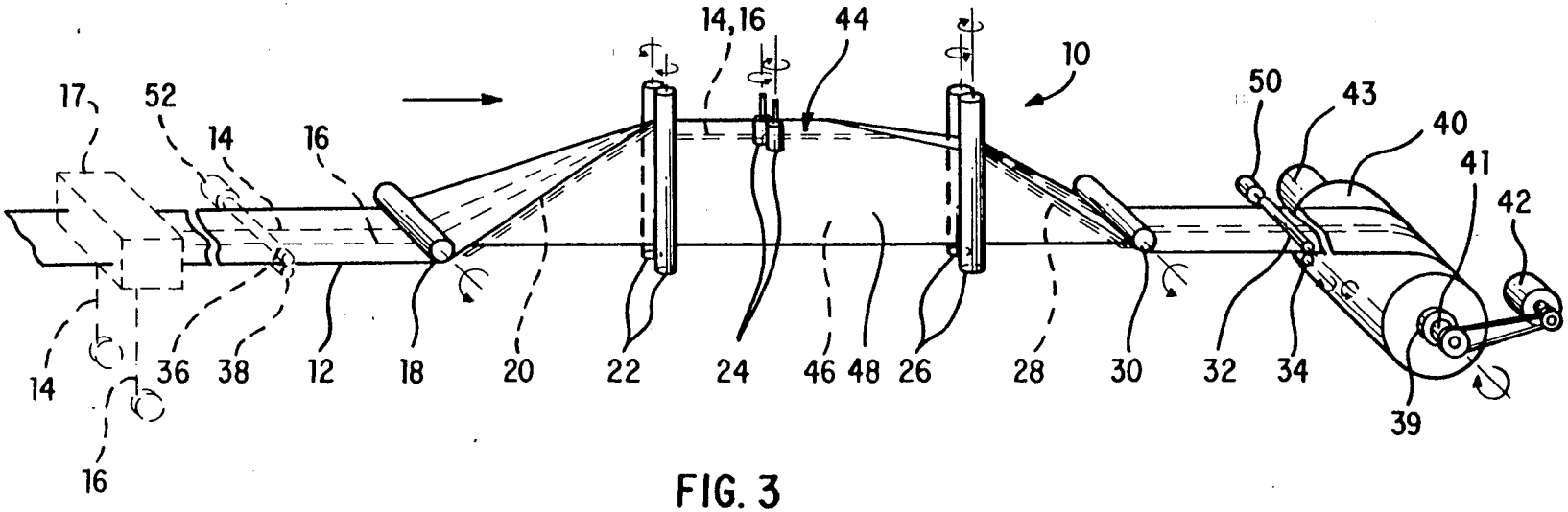
FIG. 3 is a schematic side perspective view of the apparatus of the present invention.

Referring to FIGS. 2 and 3, the apparatus 10 of the present invention is schematically shown producing a roll 40 of Z-folded film. In accordance with the method of the present invention, web 12, such as shown in FIG. 4, is provided. Preferably made of thermoplastic material, web 12 is opened flat with male and female zipper elements 14, 16, respectively, spaced apart and attached thereto. The web may be extruded or otherwise supplied upstream of apparatus 10. If extruded or supplied without zipper elements, zipper elements 14, 16 may be attached to web 12 by any of the many methods known in the art, such as fusing or lamination, shown representatively at 17 in FIGS. 2 and 3.

Web 12 is then folded to bring male and female zipper elements 14, 16 into opposing relationship. The step of folding, as representatively shown in FIG. 5, is preferably performed on folding board 20. Zipper elements 14, 16 are brought into close proximity as web 12 passes over folding board 20. Zipper elements 14, 16 are thereafter interlocked, as shown in FIG. 6. The step of interlocking is preferably performed by advancing web 12 through a pair of spring-loaded joiner rollers 24. As best shown in FIG. 6, a folded lip 44 is thereby defined in the portion of web 12 between zipper elements 14, 16, and first and second web panels 46, 48 defined in the remaining web portions.

Folded lip 44 is next urged to lay flat against one of web panels 46, 48. Preferably the step of urging is performed by holding lip 44 against a web panel while advancing web 12 through pinch rollers 26. Thereafter, web 12 is unfolded, beginning at a point below interlocked zipper elements 14, 16, as shown representatively in FIG. 7. After unfolding, web 12 lays open while interlocked zipper elements 14, 16 are closed. Lip 44 lays flat against either first or second web panel 46 or 48, so that the web resembles a "Z" in cross-section, as shown in FIG. 8. In the final step, web 12, thus unfolded, is wound into roll 40 for later use at bag making or packaging machine.

Referring again to FIGS. 2 and 3, apparatus 10 of the present invention comprises a series of rotatable rollers, rotatable roller pairs and other elements which may be positioned and mounted either in separate stations, as shown, or grouped together on a single frame (not shown). Means for advancing web 12 in a direction of web movement, as indicated, are placed at the outfeed or downstream end of apparatus 12 and control the tension in web 12 as it is advanced through apparatus 10. Shown in FIGS. 2 and 3, nip rollers 32, 34 are preferred as means for advancing web 12. Nip roller 32 may be driven by a source of rotary power, such as motor 50, connected by means known in the art, while nip roller 34 turns by frictional contact with web 12 and nip roller 32. Nip rollers 32, 34 may also be spring-loaded. Preferably nip roller 32 is comprised of stainless or carbon steel, while nip roller 34 is has a rubber surface. The rubber surface improves frictional contact with web 12 and its resiliency inhibits damage to zipper elements 14, 16. In a preferred alternative embodiment, a second set of nip rollers 36, 38 are placed at the infeed or upstream end of apparatus 10, made and operated in like fashion with motor 52 as nip rollers 32, 34.

Web 12 entering apparatus 10 advances to a means for folding web 12. The means for folding includes folding board 20 preceded by first idler roller 18 and followed by a pair of first pinch rollers 22. First idler roller 18 and first pinch rollers 22 are rotatably driven by frictional contact with web 12. First pinch rollers 22 are preferably made of aluminum, for light weight. First pinch rollers 22 are spring-loaded, and serve to ensure that web 12 uniformly advances and folds across folding board 20. Folding board 20 may comprise a triangular sheet of material, such as metal, preferably having rounded edges over which web 12 folds, and includes cut-outs or apertures to reduce surface contact with web 12 and minimize drag. This arrangement folds the web along a longitudinal line generally parallel to the direction of web movement, and at the downstream end of the folding board, brings male and female zipper elements 14, 16 into opposing relationship, sandwiched between portions of web 12. Preferably, zipper elements 14, 16 are disposed near the center of web 12, as shown in FIG. 4.

Downstream therefrom, means for interlocking the zipper elements, such as a pair of spring-loaded joining rollers 24, are provided to interlock zipper elements 14, 16. Joining rollers are also rotatably driven by frictional contact with web 12. Means for interlocking, such as fixed plate joiners, may also be used, however, joining rollers 24 are preferred. Regardless, again, as best shown in FIGS. 6 and 7, a folded lip 44 is defined in the area between zipper elements 14, 16, and the remaining portions of the web define first and second web panels 46, 48.

Downstream from joining rollers 24 are means for urging lip 44 to lay flat against one of web panels 46, 48. Preferably, the means for urging include a pair of second pinch rollers 26 which also rotate by frictional contact with web 12. Second pinch rollers 26 urge lip 44 to lay flat against one of web panels 46, 48 by holding lip 44 in that position as it advances therethrough to means for unfolding. Second pinch rollers 26 are also preferably made of metal such as aluminum. Second pinch rollers 26 ensure that lip 44 lays sideways against one of web panels 46, 48 before reaching unfolding board 28, preventing zipper elements 14, 16 and lip 44 from simply squashing down during unfolding of the web.

The means for unfolding preferably includes unfolding board 28, positioned downstream from second pinch rollers 26 and located at a position offset from interlocked zipper elements 14, 16 so as not to unlock zipper elements 14, 16. That is, as shown in the configuration in FIGS. 2 and 3, lowering unfolding board 28 so that the upper portion thereof is lower than a line horizontal to interlocked zipper elements 14, 16, causes unfolding of web 12 to begin below zipper elements 14, 16, without causing the zipper elements to separate. The distance unfolding board 28 is offset is determined by the length of lip 44. If lip 44 is longer, zipper elements 14, 16 are disposed further down opposing sides of web 12. Alternatively, rather than lowering unfolding board 28 as shown, folding board 20 could be raised to create the desired difference in elevation.

Unfolding board 28 is made in like fashion as folding board 20, including rounded edges and cut-outs to reduce drag. The means for unfolding further includes second idler roller 30 at the downstream end of unfolding board 28 to complete unfolding of web panels 46, 48 initiated by unfolding board 28. Web 12 emerges from contact with second idler roller 30 in substantially open position, with zipper elements 14, 16 closed, and folded lip 44 laid flat against a web panel, as shown illustratively in FIG. 7.

Web 12 thereafter advances through nip rollers 32, 34, and is wound on core 39 into roll 40 of Z-folded film by means for winding. Means for winding preferably include a removable spool 41 driven by a source of rotary power, such as motor 42. Spool 41 preferably includes a pneumatic chuck for gripping core 39. During winding, spool 41 is oscillated transverse to the direction of web movement by means for oscillating, preferably a hydraulic cylinder 43 which cyclically extends and retracts by action of limit switches (not shown).

Thus, for example where a 12 inch wide web 12 is wound, hydraulic cylinder 43 may oscillate approximately 6 to 8 inches. As a result, web 12 and interlocked zipper elements 14, 16 wander across roll 40 to distribute the extra thickness of the interlocked zipper elements 14, 16 reducing pressure on zipper elements 14, 16 and producing a roll 40 which is harder in the middle and softer near the edges. The maximum amount of oscillation which may be applied while maintaining a stable roll is preferred to maximize the distribution of pressure across roll 40.

Finally, any or all of the various rollers such as idler rollers 18, 30, first and second pinch rollers 22, 26, nip rollers 32, 34, 36 and 38, or joiner rollers 24 may incorporate grooves to accommodate one or more zipper elements 14, 16, and still function as described. Materials of construction, connection, support, and means for driving are as known in the art unless otherwise described.

While certain representative embodiments and details have been shown and described for purposes of illustrating the invention, it will be apparent to those skilled in the art that various changes in the apparatus disclosed herein may be made without departing from the scope of the invention which is defined in the appended claims.

What is claimed is:

1. A method for making rolls of Z-folded closed zipper, open web film comprising the steps of:

providing an open web of flexible material having at least one male and at least one female zipper element thereon in spaced relationship;

folding said web, bringing said male and female zipper elements into opposing relationship with mating ones thereof;

interlocking said opposing male and female zipper elements, defining a folded lip in the portion of said web between said male and female zipper elements and further defining first and second web panels in remaining portions of said web;

urging said folded lip to fold against one of said web panels;

unfolding said folded web to position said first and second web panels and said folded lip in substantially parallel planes; and winding said web into a roll.

2. A method as recited in claim 1 wherein said step of providing comprises the steps of:

separately supplying a web of thermoplastic material and male and female zipper elements; and fusing said male and female zipper elements to said web in spaced relationship substantially near the center of said web.

3. A method as recited in claim 1 wherein said step of folding comprises folding said web on a folding board and bringing said male and female zipper elements into opposing relationship as said web passes over and reaches the end of said folding board.

4. A method as recited in claim wherein said step of interlocking said male and female zipper elements comprises advancing said folded web between at least one pair of joiner rolls.

5. A method as recited in claim 1 wherein said step of urging said lip to fold against one of said web panels comprises holding said lip in a folded position against one of said web panels while passing said web through at least one pair of pinch rollers disposed upstream of said unfolding table.

6. A method as recited in claim 1 wherein said step of unfolding comprises unfolding said web on an unfolding table, beginning said unfolding along a point below said interlocked zipper elements.

7. An apparatus for producing rolls of Z-folded closed zipper open web film from a web of flexible material having at least one male and at least one female zipper element spaced apart thereon, said apparatus comprising:

means for advancing said web in a direction of web movement engaging said web;

means for folding said web, said means for folding adapted to bring said male and female zipper elements into opposing relationship and form a folded edge above said zipper elements;

means for interlocking said opposing male and female zipper elements, whereby a folded lip may be defined in said web between said zipper elements, and first and second web panels may be defined in portions of said web below said zipper elements;

means for urging said folded lip to fold substantially flat against one of said web panels;

means for unfolding said first and second web panels; and means for winding said web into a roll.

8. An apparatus as recited in claim 7 wherein said means for advancing said web comprises one or more pairs of nip rollers between which portions of said web are engaged.

9. An apparatus as recited in claim 7 wherein said means for folding folds said web along a longitudinal line generally parallel to said direction of web movement.

10. An apparatus as recited in claim 7 wherein said means for folding comprises:

at least one first idler roller;

a folding board disposed downstream therefrom; and at least one pair of first pinch rollers disposed immediately downstream from said folding board.

11. An apparatus as recited in claim 7 wherein said means for interlocking comprises at least one pair of joining rollers.

12. An apparatus as recited in claim 7 wherein said means for urging comprises at least one pair of second pinch rollers disposed downstream from said joining rollers, said second pinch rollers adapted to fold said lip against one of said web panels as said lip passes through said second pinch rollers.

13. An apparatus as recited in claim 12 wherein said means for unfolding comprises:

an unfolding board disposed downstream from said second pinch rollers; and at least one second idler roller disposed downstream from said unfolding board.

14. An apparatus as recited in claim 7 wherein said means for folding comprises a folding board, and said means for unfolding comprises a unfolding board, said unfolding board disposed at a level below that of said folding board.

15. An apparatus as recited in claim 7 wherein said means for winding comprises a rotatable spool, a chuck for engaging a core, and means for rotatably driving said spool.

16. An apparatus as recited in claim 15 wherein said means for winding further comprises means for oscillating said spool transverse to the direction of web movement.

* * * * *